US010134381B2

(12) United States Patent
Pfaffinger

(10) Patent No.: US 10,134,381 B2
(45) Date of Patent: Nov. 20, 2018

(54) NOISE AND VIBRATION SENSING

(71) Applicant: Harman Becker Automotive Systems GmbH, Karlsbad (DE)

(72) Inventor: Gerhard Pfaffinger, Regensburg (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 15/762,007

(22) PCT Filed: Aug. 25, 2016

(86) PCT No.: PCT/EP2016/070030

§ 371 (c)(1),
(2) Date: Mar. 21, 2018

(87) PCT Pub. No.: WO2017/050515

PCT Pub. Date: Mar. 30, 2017

(65) Prior Publication Data

US 2018/0268803 A1 Sep. 20, 2018

(30) Foreign Application Priority Data

Sep. 25, 2015 (EP) ..... 15186882

(51) Int. Cl.
*G10K 11/178* (2006.01)

(52) U.S. Cl.
CPC .. *G10K 11/17883* (2018.01); *G10K 11/17823* (2018.01); *G10K 11/17835* (2018.01);
(Continued)

(58) Field of Classification Search
CPC ..... G10K 11/17883; G10K 11/17835; G10K 11/17823; G10K 2210/129;
(Continued)

(56) References Cited

U.S. PATENT DOCUMENTS 5,561,598 A * 10/1996 Nowak ..... G05B 13/024 381/71.11
5,809,152 A 9/1998 Nakamura et al.
(Continued)

FOREIGN PATENT DOCUMENTS

WO 2014115533 A1 7/2014

*Primary Examiner* — David Ton
(74) *Attorney, Agent, or Firm* — Brooks Kushman P.C.

(57) ABSTRACT

An example active road noise control includes generating with a sensor arrangement a primary sense signal representative of at least one of accelerations, motions and vibrations that occur at a first position, and providing a noise reducing signal by processing the primary sense signal according to an adaptive mode of operation or a non-adaptive mode of operation. It further includes generating within the vehicle body noise reducing sound at the second position from the noise reducing signal, evaluating the primary sense signal and controlling the processing of the primary sense signal so that the primary sense signal is processed in the adaptive mode of operation when the magnitude of the primary sense signal undercuts a first threshold and in the non-adaptive mode of operation when the magnitude of the primary sense signal exceeds a second threshold, the first threshold being equal to or smaller than the second threshold.

20 Claims, 6 Drawing Sheets

(52) U.S. Cl.
CPC ..... *G10K 2210/129* (2013.01); *G10K 2210/12821* (2013.01); *G10K 2210/3045* (2013.01); *G10K 2210/3046* (2013.01); *G10K 2210/30391* (2013.01)

(58) Field of Classification Search
CPC . G10K 2210/30391; G10K 2210/3045; G10K 2210/3046
See application file for complete search history.

(56) References Cited

U.S. PATENT DOCUMENTS

| | | | | |
|---|---|---|---|---|
| 8,565,443 | B2 * | 10/2013 | Wurm ..... | G10K 11/178 381/71.11 |
| 2007/0076896 | A1 | 4/2007 | Hosaka et al. | |
| 2012/0140943 | A1 | 6/2012 | Hendrix et al. | |
| 2014/0072134 | A1 | 3/2014 | Po et al. | |
| 2014/0105412 | A1 * | 4/2014 | Alves ..... | G10K 11/178 381/71.6 |
| 2015/0104031 | A1 * | 4/2015 | Park ..... | G10K 11/178 381/71.6 |

* cited by examiner

NOISE AND VIBRATION SENSING

CROSS-REFERENCE TO RELATED APPLICATION

This application is the U.S. national phase of PCT Application No. PCT/EP2016/070030 filed on Aug. 25, 2016, which claims priority to EP Patent Application No. 15186882.5 filed on Sep. 25, 2015, the disclosures of which are incorporated in their entirety by reference herein.

FIELD

The disclosure relates to active road noise control systems and noise and vibration measurement methods.

BACKGROUND

Land based vehicles, when driven on roads and other surfaces, generate low frequency noise known as road noise. Even in modern vehicles, cabin occupants may be exposed to road noise that is transmitted through the structure, e.g. tires-suspension-body-cabin path, and through airborne paths, e.g. tires-body-cabin path, to the cabin. It is desirable to reduce the road noise experienced by cabin occupants. Active Noise, vibration, and harshness (NVH) control technologies, also known as active road noise control (RNC) systems, can be used to reduce these noise components without modifying the vehicle's structure as in active vibration technologies. However, active sound technologies for road noise cancellation may require very specific noise and vibration (N&V) sensor arrangements throughout the vehicle structure in order to observe road noise related noise and vibration signals.

SUMMARY

An example active road noise control system includes a sensor arrangement configured to generate a primary sense signal representative of at least one of accelerations, motions and vibrations that occur at a first position on a vehicle body, the sense signal having an magnitude, and an active road noise control module configured to provide a noise reducing signal by processing the primary sense signal according to an adaptive mode of operation or a non-adaptive mode of operation at a time. The system further includes at least one loudspeaker configured to generate noise reducing sound at a second position within the vehicle body from the noise reducing signal, the at least one loudspeaker being disposed at a third position within the vehicle body, and an overload detection module configured to evaluate the primary sense signal and to control the active road noise control module so that the active road noise control module operates in the adaptive mode of operation when the magnitude of the primary sense signal undercuts a first threshold and operates in the non-adaptive mode of operation when the magnitude of the primary sense signal exceeds a second threshold, the first threshold being equal to or smaller than the second threshold.

An example active road noise control method includes generating with a sensor arrangement a primary sense signal representative of at least one of accelerations, motions and vibrations that occur at a first position on a vehicle body, wherein the sense signal has a magnitude, and providing a noise reducing signal by processing the primary sense signal according to an adaptive mode of operation or a non-adaptive mode of operation. The method further includes generating within the vehicle body noise reducing sound at the second position from the noise reducing signal, and evaluating the primary sense signal and controlling the processing of the primary sense signal so that the primary sense signal is processed in the adaptive mode of operation when the magnitude of the primary sense signal undercuts a first threshold and in the non-adaptive mode of operation when the magnitude of the primary sense signal exceeds a second threshold, the first threshold being equal to or smaller than the second threshold.

BRIEF DESCRIPTION OF THE DRAWINGS

The disclosure may be better understood by reading the following description of non-limiting embodiments to the attached drawings, in which like elements are referred to with like reference numbers, wherein below.

DETAILED DESCRIPTION

Noise and vibration sensors provide reference inputs to active road noise control (RNC) systems, e.g., multichannel feedforward active RNC systems, as a basis for generating the anti-noise that reduces or cancels road noise. Noise and vibration sensors may include acceleration sensors such as accelerometers, force gauges, load cells, etc. For example, an accelerometer is a device that measures proper acceleration. Proper acceleration is not the same as coordinate acceleration, which is the rate of change of velocity. Single- and multi-axis models of accelerometers are available for detecting magnitude and direction of the proper acceleration, and can be used to sense orientation, coordinate acceleration, motion, vibration, and shock.

Airborne and structure-borne noise sources are monitored by the noise and vibration sensors, in order to provide the highest possible road noise reduction (cancellation) performance between 0 Hz and 1 kHz. For example, acceleration sensors used as input noise and vibration sensors may be disposed across the vehicle to monitor the structural behavior of the suspension and other axle components for global RNC. Above a frequency range that stretches from 0 Hz to approximately 500 Hz, acoustic sensors that measure the airborne road noise may be used as reference control inputs. Furthermore, one or more microphones may be placed in the headrest(s) in close proximity of the passenger's ears to provide an error signal or error signals in case of binaural reduction or cancellation. The feedforward filters are tuned or adapted to achieve maximum noise reduction or noise cancellation at both ears.

Figure 1:
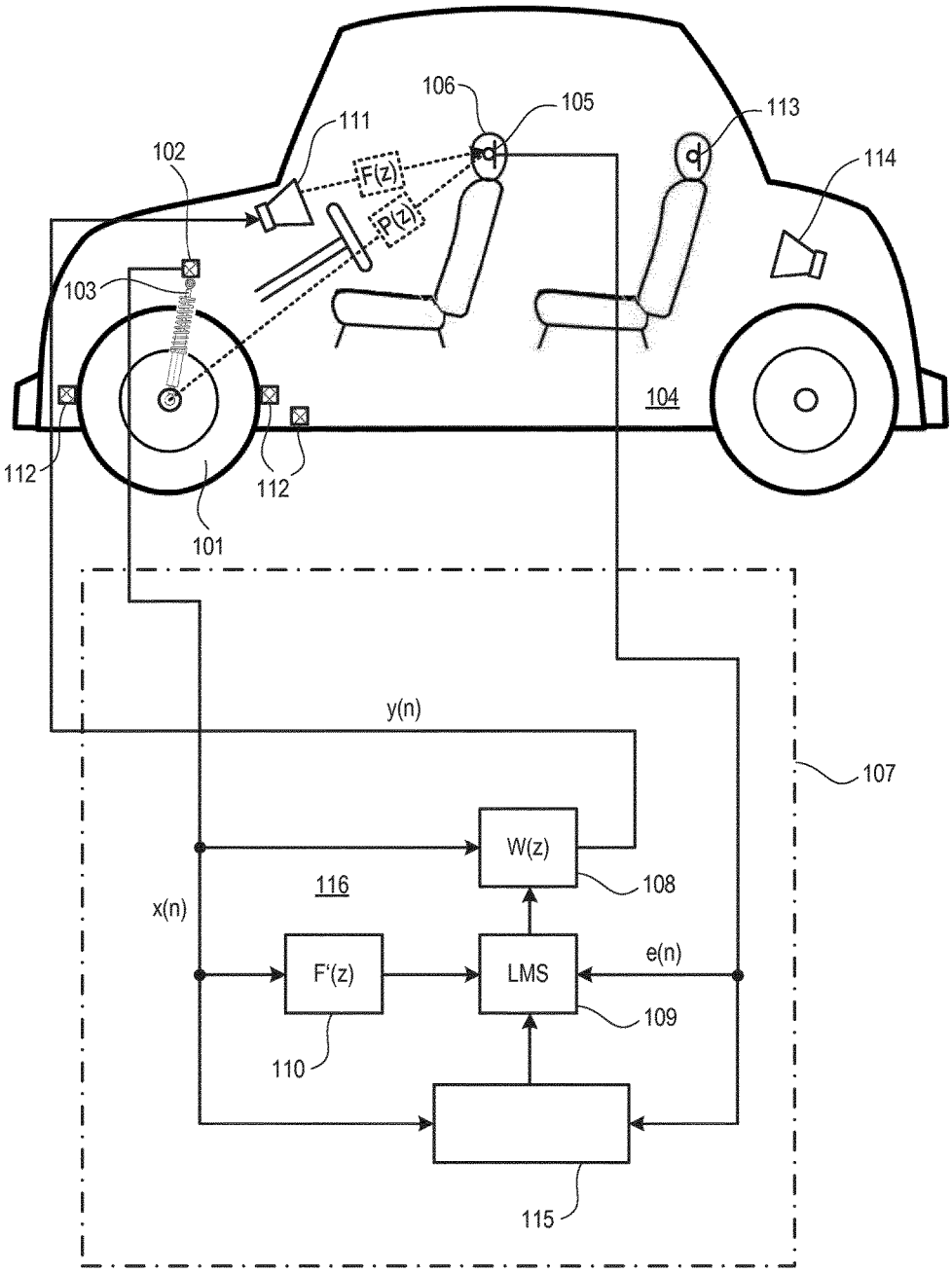
FIG. 1 is a schematic diagram illustrating an exemplary simple single-channel active road noise control system.

A simple single-channel feedforward active RNC system may be constructed as shown in FIG. 1. Vibrations that originate from a wheel 101 moving on a road surface are detected by a suspension acceleration sensor 102 which is mechanically coupled with a suspension device 103 of an automotive vehicle 104 and which outputs a noise and vibration signal x(n) that represents the detected vibrations and, thus, correlates with the road noise audible within the cabin. At the same time, an error signal e(n) representing noise present in the cabin of the vehicle 104 is detected by an acoustic sensor, e.g., a microphone 105, arranged within the cabin in a headrest 106 of a seat (e.g., the driver's seat). The road noise originating from the wheel 101 is mechanically transferred to the microphone 105 according to a transfer characteristic P(z).

A transfer characteristic W(z) of a controllable filter 108 is controlled by an adaptive filter controller 109 which may operate according to the known least mean square (LMS) algorithm based on the error signal e(n) and on the road noise signal x(n) filtered with a transfer characteristic F'(z) by a filter 110, wherein W(z)=−P(z)/F(z). F'(z)=F(z) and F(z) represents the transfer function between a loudspeaker and the microphone 105. A signal y(n) having a waveform inverse in phase to that of the road noise audible within the cabin is generated by an adaptive filter formed at least by controllable filter 108 and filter controller 109, based on the thus identified transfer characteristic W(z) and the noise and vibration signal x(n). From signal y(n) a waveform inverse in phase to that of the road noise audible within the cabin is then generated by the loudspeaker 111, which may be arranged in the cabin, to thereby reduce the road noise within the cabin. The exemplary system described above employs an active RNC module 107 with a straightforward single-channel feedforward filtered-x LMS control structure for the sake of simplicity, but other control structures, e.g., multi-channel structures with a multiplicity of additional channels, a multiplicity of additional noise sensors 112, a multiplicity of additional microphones 113, and a multiplicity of additional loudspeakers 114, may be applied as well.

The system shown in FIG. 1 further includes an overload detection module 115 that evaluates the operational state of the acceleration sensor 102 and optionally the microphone 105, which together form a simple sensor arrangement. In this example, overload detection module 115 evaluates the sense signals from the acceleration sensor 102 and optionally the microphone 105, e.g., the noise and vibration signal x(n) and optionally the error signal e(n), and controls an active road noise control module that includes the adaptive filter 116 so that the adaptive filter 116 operates in an adaptive mode of operation when the magnitude of the primary sense signal undercuts a first threshold and operates in a non-adaptive mode of operation when the magnitude of the primary sense signal exceeds a second threshold, the first threshold being equal to or smaller than the second threshold. If the first threshold and the second threshold are equal, a simple switching behavior is established. If the first threshold is smaller than the second threshold, a hysteresis behavior is established. Magnitude of a signal is understood herein to be the absolute value of the signal's momentary value. Optionally, the additional acceleration sensors 112 and the additional microphone 113 may be connected to the overload detection module 115 for further evaluation (connections not shown in FIG. 1).

Figure 2:
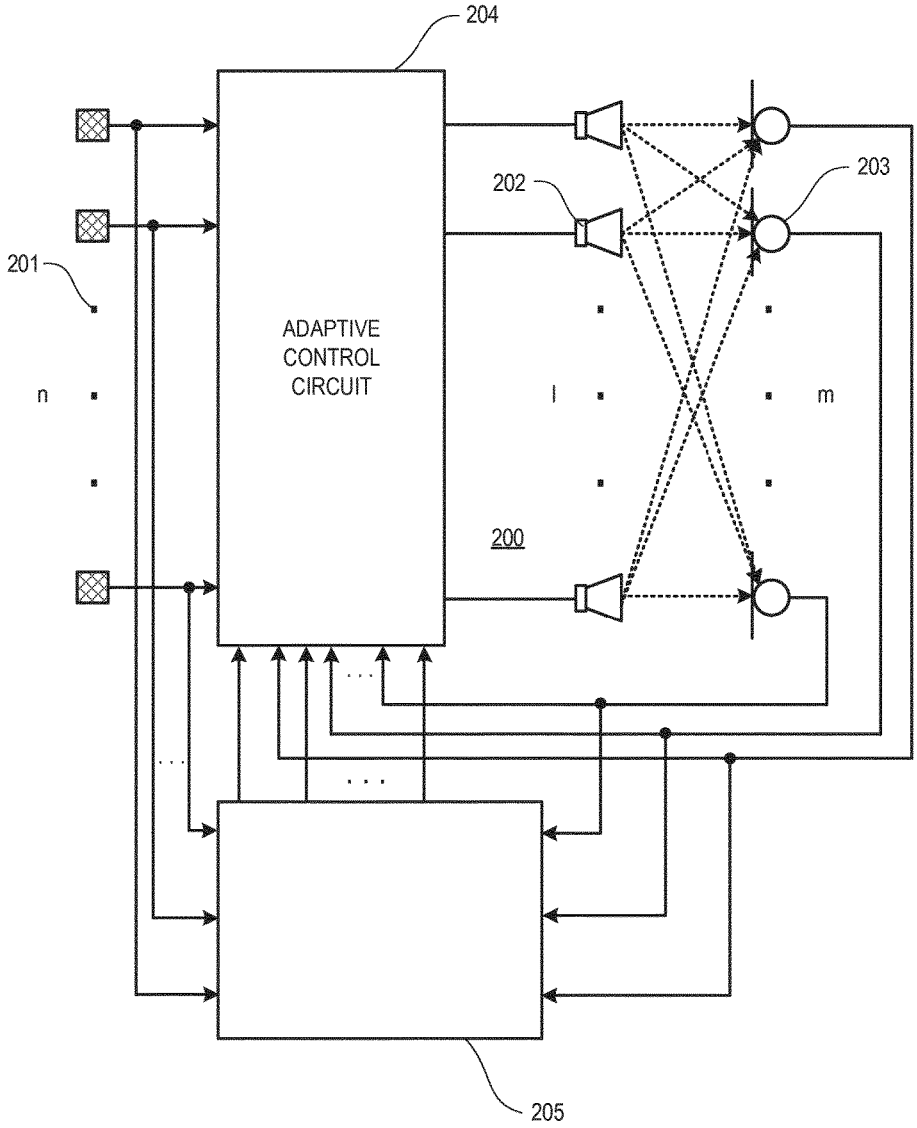
FIG. 2 is a schematic diagram illustrating an exemplary simple multi-channel active road noise control system.

FIG. 2 shows an active road noise control system 200 which is a multi-channel type active RNC system capable of suppressing noise from a plurality of noise and vibration sources. The active RNC system 200 comprises a multiplicity n of noise and vibration sensors 201, a multiplicity l of loudspeakers 202, a multiplicity m of microphones 203 (acoustic sensors), and an adaptive multi-channel active RNC module 204 which operates to minimize the error between noise from the noise and vibration sources (primary noise) and cancelling noise (secondary noise). The RNC module 204 may include a number of control circuits provided for each of the loudspeakers 202, which create cancelling signals for cancelling noise (i.e., anti-noise) from corresponding noise and vibration sources.

The system shown in FIG. 2 further includes a multi-channel overload detection module 205 that evaluates the operational state of the acceleration sensors 201 (and optionally the microphones 203), which together form another sensor arrangement. In this example, overload detection module 205 evaluates the sense signals from the acceleration sensors 201 (and the microphones 203), and controls an active road noise control module formed by, e.g., the RNC module 204 so that the RNC module 204 operates in an adaptive mode of operation when the magnitude of the primary sense signal undercuts a first threshold and operates in the non-adaptive mode of operation when the magnitude of the primary sense signal exceeds a second threshold, wherein the first threshold is equal to or smaller than the second threshold.

In conventional active RNC systems, overload of only one sensor can deteriorate the system performance significantly or can even give rise to unwanted audible artifacts. Therefore, in conventional systems a considerable sense signal headroom is provided which, however, reduces the usable dynamics of the sensors. Furthermore, the challenge for successful overload detection is how to proceed with this information other than just switching off the whole system. The decision on how to proceed may depend on information such as how many sensors exhibit an overload situation, which and what types of sensors exhibit overload situations, how significant the detected overload situations are, and what their specific effects on the system are. The exemplary overload detection modules 115 and 205 evaluate the overload status of the sensors, determine, based on their evaluations, whether one or more of the sensors exhibit an overload and, optionally, determine how severe the overload is.

Figure 3:
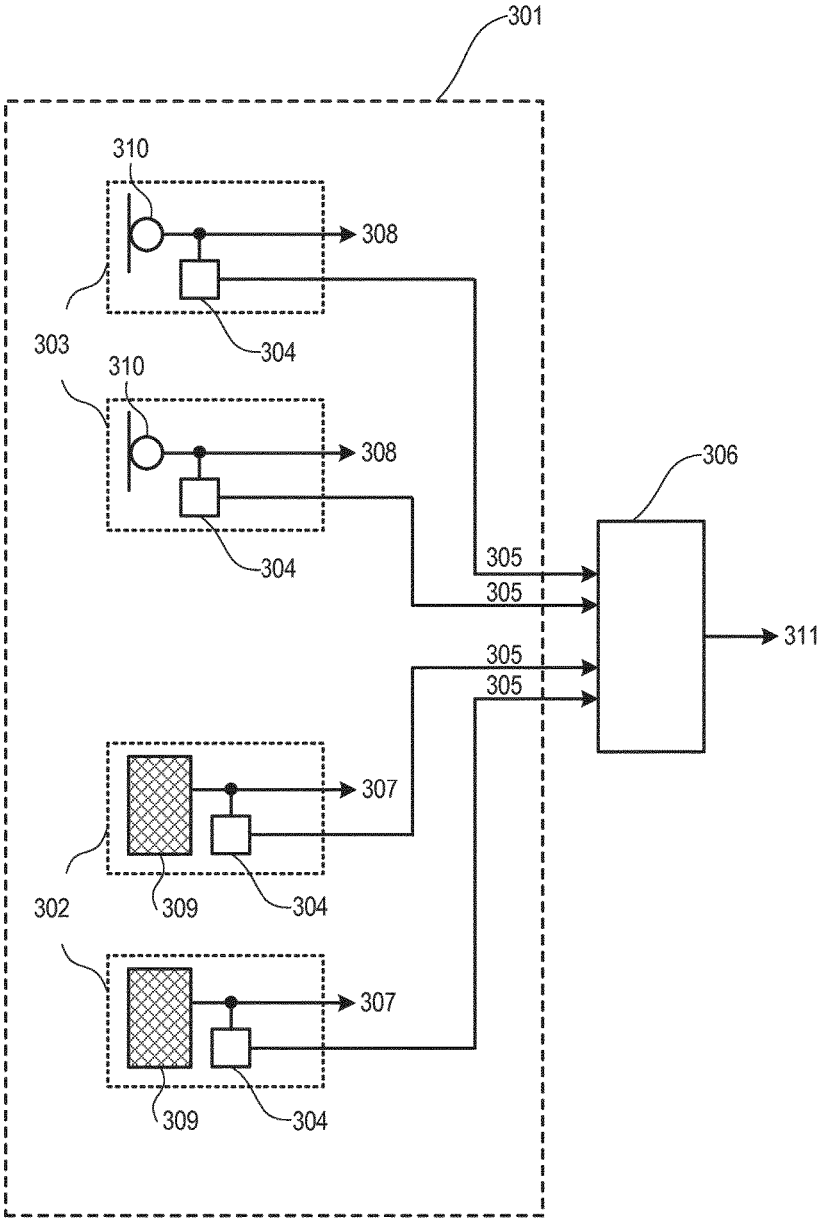
FIG. 3 is a schematic diagram illustrating a noise and vibration sensor arrangement with overload detection modules.

An exemplary way to evaluate, determine and/or detect an overload situation is shown in FIG. 3. A sensor arrangement 301 includes a multiplicity of noise and vibration sensors 302 including acceleration sensors 309, and acoustic sensors 303 including microphones 310 to provide output signals 308. Exemplary built-in overload detection modules 304 may be integrated in each noise and vibration sensor 302 and optionally in at least some of the acoustic sensors 303 to test the respective sensor. If at least one of the built-in overload detection modules 304 detects an overload, it generates an overload (indication) signal 305 indicating the overload situation and identifying the overloaded sensor to an overload processing module 306 which outputs a signal 311 representative of a sensor overload. The built-in overload detection module 304 may include at least one threshold, to which the sense signal is compared in order to detect an overload and, optionally, to identify the type of overload, e.g., close to threshold, full overload etc.

An exemplary overload detection and processing set-up as shown in FIG. 3 may be operable to test each sensor per se, e.g., with the built-in self-test modules 304 described above in connection with FIG. 3. Based on the test results, additionally the overload status of groups of sensors or simply all sensors of an active road noise system may be evaluated by overload processing module 306. Groups of sensors may be formed according to different criteria such as groups of only acoustic sensors, groups of only noise and vibration sensors, groups of adjacent sensors, groups of pairs of an acoustic sensor and a noise and vibration sensor etc. The built-in self-test modules 304 in the noise and vibration sensors 302 may generate at least one additional signal or bit which may be evaluated as separate signal/bit or be combined with the noise and vibration sensors' output signal 307 (e.g., as additional bit). Similarly, the built-in self-test modules 304 in the acoustic sensors 303 may generate at least one additional signal or bit which may be evaluated as separate signal or be combined with the acoustic sensors' output signal 305.

Figure 4:
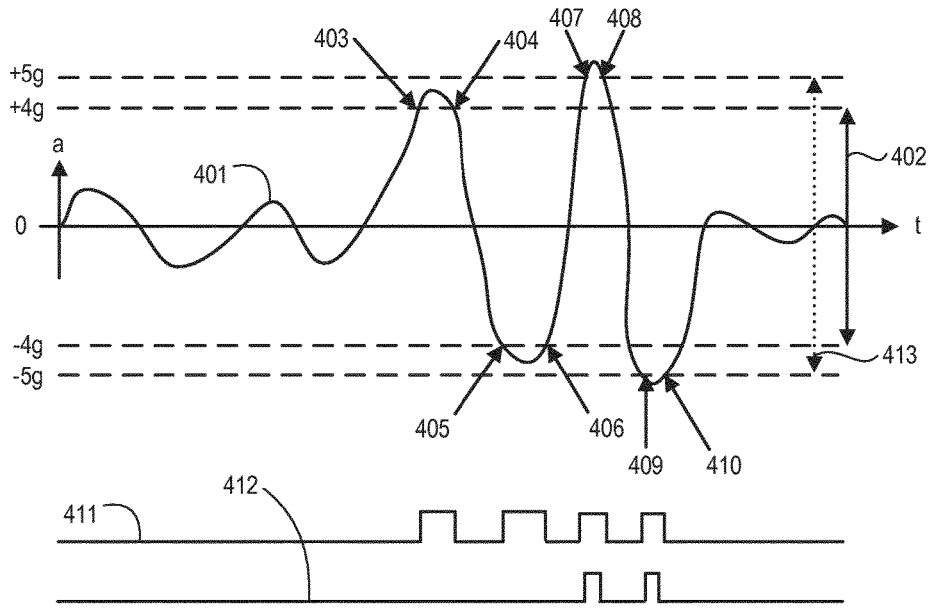
FIG. 4 is a graph illustrating the evaluation of an acceleration sensor signal.

FIG. 4 is an acceleration (a) vs. time (t) diagram which illustrates one example operation of a sensor diagnostic method for an acceleration sensor. In this example, a sense signal 401 is represented in physical units of acceleration, i.e. 1 g=9.81 m/s2. A predetermined range 402 extends between positive 4 g and negative 4 g corresponding to a magnitude of between 0 and 4 g. It is to be understood that the size of the predetermined range 402 can vary based on the type of sensor, sensitivity of the sensor, and the expected driving conditions of the vehicle. The sense signal 401 may be first within the predetermined range 402. The sense signal 401 leaves the predetermined range 402 at a point 403 in a positive direction, i.e., exceeds threshold 4 g, causing an overload signal 411 to be set. At a point 404, the sense signal 401 returns into the predetermined range 402 and the overload signal 411 is reset. The sense signal 401 leaves the predetermined range 402 at a point 405 in a negative direction, i.e., undercuts threshold −4 g, causing the overload signal 411 to be set again. At a point 406, the sense signal 401 returns to the predetermined range 402 and the overload signal 411 is reset again.

In the example illustrated in FIG. 4, the sensor signal continues to oscillate into and out of the predetermined range 402 and the overload signal 411 indicates the overload status accordingly. Another predetermined range 413 may be provided which extends between positive 5 g and negative 5 g corresponding to a magnitude of between 0 and 4 g. The sense signal 401 leaves the predetermined range 413 at a point 407 in a positive direction, i.e., exceeds threshold 5 g after having exceeded threshold 4 g, causing an overload signal 412 to be set while overload signal 411 was set shortly before. At a point 408, the sense signal 401 returns to the predetermined range 413 and subsequently to predetermined range 402, so that the overload signal 412 and subsequently the overload signal 411 is reset. The sense signal 401 leaves the predetermined range 413 at a point 409 in a negative direction, i.e., undercuts threshold −5 g after undercutting threshold −4 g, causing the overload signal 412 to be set again while overload signal 411 was set shortly before. At a point 410, the sense signal 401 returns to the predetermined range 413 and subsequently to predetermined range 402, so that the overload signal 412 is reset again while overload signal 411 was reset shortly before. A hysteresis behavior can be established by setting, for example, overload signal 411 when signal 401 leaves range 413 and setting overload signal 411 when signal 401 returns to range 402.

Figure 5:
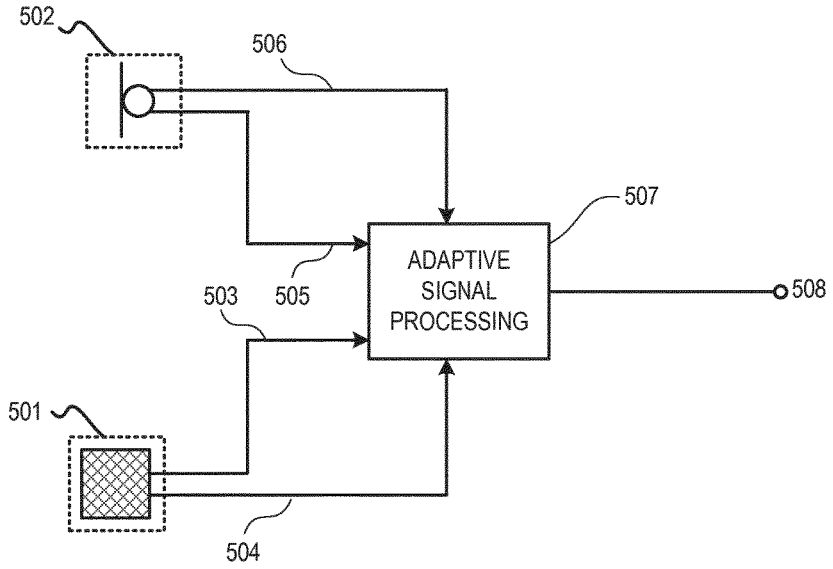
FIG. 5 is a diagram illustrating an adaptive active road noise control module.

Referring to FIG. 5, when overload of at least one sensor is detected, an active road noise control module 507 is controlled to change from an adaptive mode to a non-adaptive mode. Active road noise control module 507 may be connected to (at least one) noise and vibration sensor 501 via an output signal line transferring a corresponding sense signal 503 and an overload indication line transferring a corresponding overload signal 504. The active road noise control module 507 may be further connected to (at least one) acoustic sensor 502 via an output signal line transferring a corresponding sense signal 505 and an overload indication line transferring a corresponding overload signal 506. The sense signals 503 and 505 are used for adaption of the active road noise control module 507 and for generating an anti-noise signal 508, while the overload signals 504 and 506 select the mode of operation of the active road noise control module 507, i.e., an adaptive mode or a non-adaptive mode.

Figure 6:
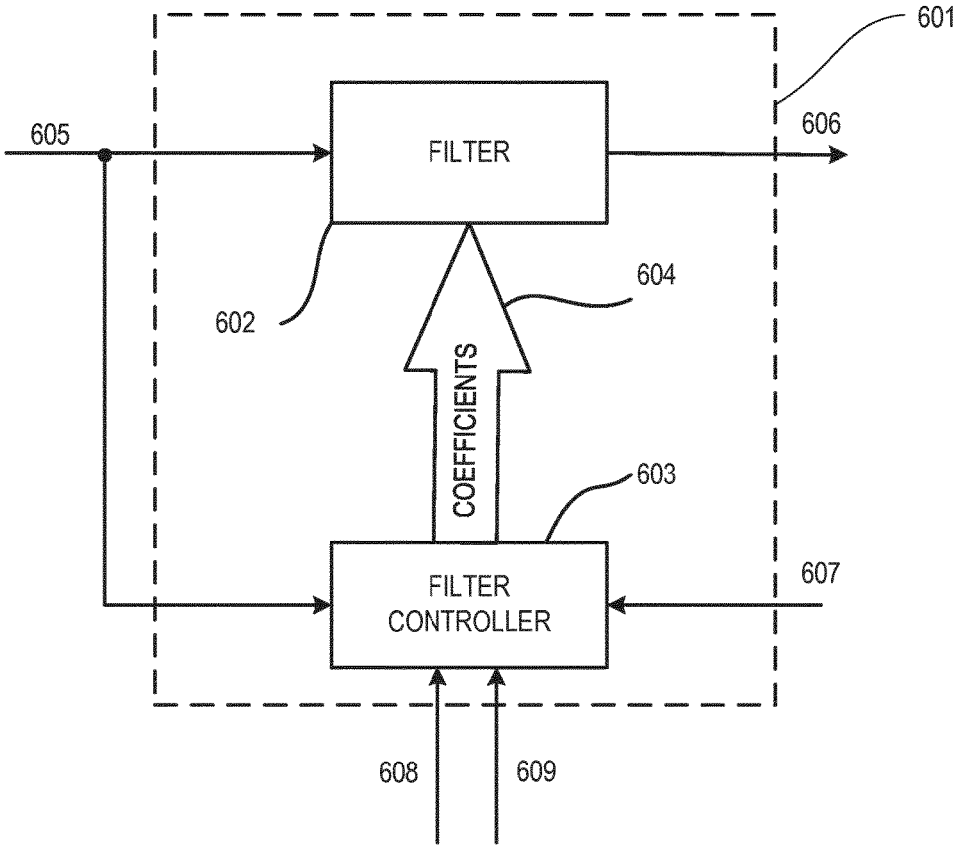
FIG. 6 is a block diagram illustrating an adaptive filter having an adaptive and non-adaptive mode of operation.

The active road noise control module 507 may include an adaptive filter 601 as described below in connection with FIG. 6. The adaptive filter 601 may include a controllable filter 602 and a filter controller 603. The controllable filter 602, which outputs an anti-noise signal 606, has a transfer function determined by filter coefficients 604 which are provided, controlled or adapted by filter controller 603, to change the transfer function of the controllable filter 602 and thus adaptive filter 601. Controllable filter 602 and filter controller 603 are supplied with an input signal 605 which may represent the sense signal 503 from the noise and vibration sensor 501 shown in FIG. 5. The filter controller 603 further receives an input signal 607 which may represent the sense signal 505 of the acoustic sensor 502 shown in FIG. 5 and an overload signal 608 which may represent the overload signal 504 of the noise and vibration sensor 501. The filter controller 603 may optionally further receive an overload signal 609 which may represent the overload signal 506 of the acoustic sensor 502.

For example, adaptive filter 601 is in its adaptive mode when no overload is detected and may have, upon successful adaption, i.e., in a fully adapted state, a first transfer function. When subsequently the noise and vibration sensor 501 indicates an overload, the adaptive filter 601 is controlled to maintain (freeze) the first transfer function and to stop the adaptation process. After returning to a non-overload situation, the adaptive filter 601 starts adapting its transfer function again beginning at the first transfer function. When again an overload situation occurs, the adaptive filter 601 may have been adapted, for example, to a second transfer function. When at this point an overload is detected, the adaptive filter 601 is controlled to maintain (freeze) the second transfer function and to stop the adaptation process. Alternatively, when an overload situation is detected, the controllable filter 602 may be set to a default (predetermined) transfer function each time an overload is detected and the adaptation process may be stopped. When returning from a default setting to an adaptive mode of operation, the adaptive filter may be reset. In still another alternative, two overlapping predetermined ranges such as predetermined ranges 402 and 413 as described above in connection with FIG. 4 may be employed, whereby using the smaller predetermined range, e.g., predetermined range 402, triggers freezing of the latest transfer function and using the larger predetermined range, e.g., predetermined range 413, sets the transfer function to the default transfer function. When entering the two predetermined ranges this process may be reversed.

Figure 7:
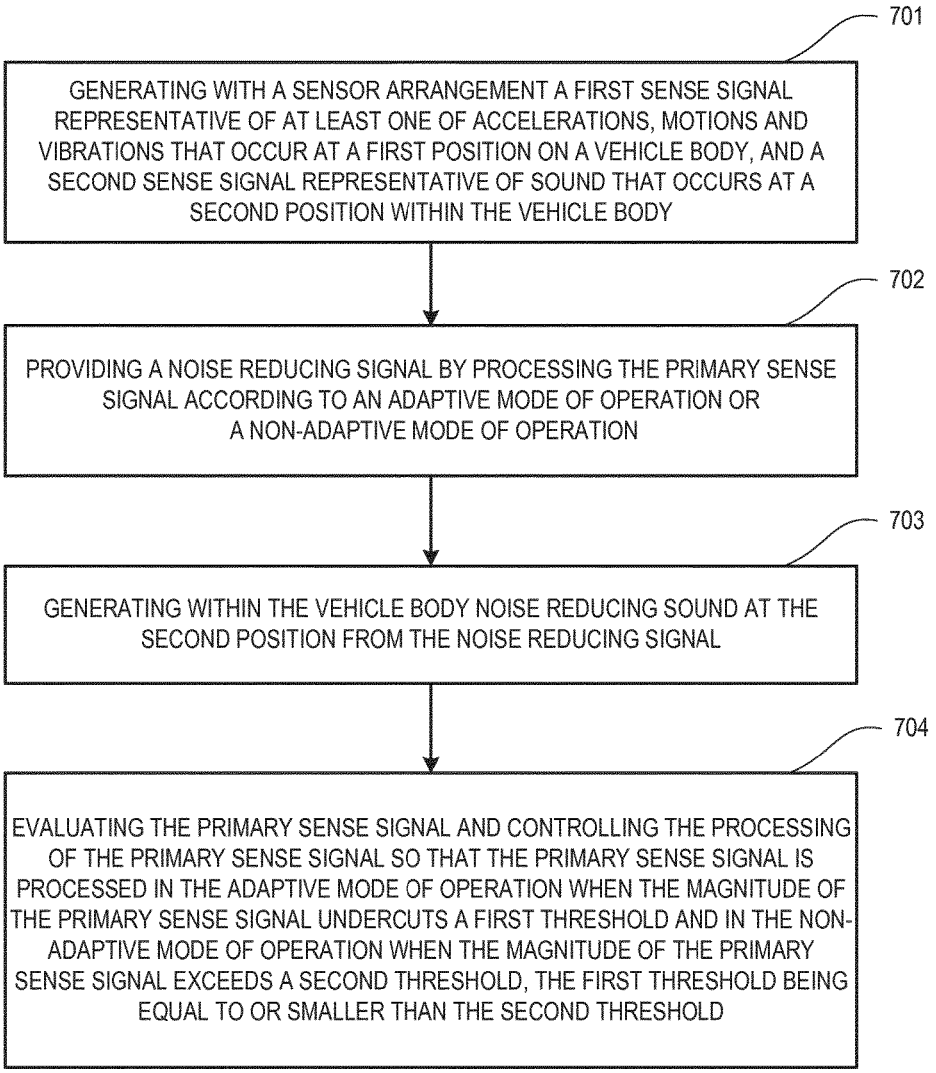
FIG. 7 is a flow chart of an example active road noise control method.

Referring to FIG. 7, an exemplary method as may be implemented in the systems described above in connection with FIGS. 1, 2 and 6 may include generating with a sensor arrangement a primary sense signal representative of at least one of accelerations, motions and vibrations that occur at a first position on a vehicle body (procedure 701), and providing a noise reducing signal by processing the primary sense signal according to an adaptive mode of operation or a non-adaptive mode of operation (procedure 702). The method further includes generating within the vehicle body noise reducing sound at the second position from the noise reducing signal (procedure 703) and evaluating the primary sense signal and controlling the processing of the primary sense signal so that the primary sense signal is processed in the adaptive mode of operation when the magnitude of the primary sense signal undercuts a first threshold and in the non-adaptive mode of operation when the magnitude of the primary sense signal exceeds a second threshold, the first threshold being equal to or smaller than the second threshold (procedure 704).

Optionally as described further above, the method may further include generating a secondary sense signal representative of sound that occurs at the second position, and providing the noise reducing signal by processing the primary sense signal and the secondary sense signal. Another option may include providing a multiplicity of primary sense signals, and comparing the multiplicity of primary sense signals with a multiplicity of first and second thresholds and controlling the active road noise control module so that the method operates in the adaptive mode of operation when the magnitudes of a first number of primary sense signals undercut their respective first thresholds and operates in the non-adaptive mode of operation when the magnitudes of a second number of primary sense signals exceed their respective second thresholds. Adaptive filtering is performed with a variable transfer function, wherein, in another option, the non-adaptive mode of operation includes stopping the adaptation and maintaining the transfer function of the adaptive filter when stopping the adaptation, or in still another option, the non-adaptive mode of operation includes stopping the adaptation and setting the transfer function of the adaptive filter to a default transfer function. When returning from a default setting to an adaptive mode of operation, the adaptive filter may optionally be reset.

The description of embodiments has been presented for purposes of illustration and description. Suitable modifications and variations to the embodiments may be performed in light of the above description or may be acquired by practicing the methods. For example, unless otherwise noted, one or more of the described methods may be performed by a suitable device and/or combination of devices. The described methods and associated actions may also be performed in various orders in addition to the order described in this application, in parallel, and/or simultaneously. The described systems are exemplary in nature, and may include additional elements and/or omit elements.

As used in this application, an element or step recited in the singular and preceded by the word "a" or "an" should be understood as not excluding the plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects.

The invention claimed is:

1. An active road noise control system comprising:

a sensor arrangement configured to generate a primary sense signal representative of at least one of accelerations, motions, and vibrations that occur at a first position on a vehicle body, the primary sense signal having a magnitude;

an active road noise control module configured to provide a noise reducing signal by processing the primary sense signal according to an adaptive mode of operation or a non-adaptive mode of operation at a time;

at least one loudspeaker configured to generate noise reducing sound at a second position within the vehicle body from the noise reducing signal, the at least one loudspeaker being disposed at a third position within the vehicle body; and an overload detection module configured to evaluate the primary sense signal and to control the active road noise control module so that the active road noise control module operates in the adaptive mode of operation when the magnitude of the primary sense signal undercuts a first threshold and operates in the non-adaptive mode of operation when the magnitude of the primary sense signal exceeds a second threshold, the first threshold being equal to or smaller than the second threshold.

2. The system of claim 1, wherein the sensor arrangement is further configured to generate a secondary sense signal representative of a sound that occurs at the second position; and the active road noise control module is further configured to provide the noise reducing signal by processing the primary sense signal and the secondary sense signal.

3. The system of claim 1, wherein the overload detection module is further configured to exhibit a hysteresis behavior between the first threshold and the second threshold.

4. The system of claim 1, wherein the sensor arrangement comprises at least one noise and vibration sensor and at least one acoustic sensor.

5. The system of claim 1, wherein the sensor arrangement comprises a multiplicity of noise and vibration sensors providing a multiplicity of primary sense signals; and the overload detection module is further configured to compare the multiplicity of primary sense signals with a multiplicity of first thresholds and a multiplicity of second thresholds and to control the active road noise control module so that the active road noise control module operates in the adaptive mode of operation when the magnitudes of a first number of the multiplicity of primary sense signals undercut their respective first thresholds and operates in the non-adaptive mode of operation when the magnitudes of a second number of the multiplicity of primary sense signals exceed their respective second thresholds.

6. The system of claim 1, wherein the active road noise control module comprises an adaptive filter with a variable transfer function; and the non-adaptive mode of operation includes stopping the adaptation and maintaining the variable transfer function of the adaptive filter when stopping the adaptation.

7. The system of claim 1, wherein the active road noise control module comprises an adaptive filter with a variable transfer function; and the non-adaptive mode of operation includes stopping the adaptation and setting the transfer function of the variable transfer function to a default transfer function.

8. The system of claim 7, wherein a change from the non-adaptive mode of operation into the adaptive mode of operation includes a reset of the active road noise control module.

9. An active road noise control method comprising:

generating with a sensor arrangement a primary sense signal representative of at least one of accelerations, motions, and vibrations that occur at a first position on a vehicle body, the sense signal having a magnitude;

providing a noise reducing signal by processing the primary sense signal according to an adaptive mode of operation or a non-adaptive mode of operation;

generating, within the vehicle body, noise reducing sound at a second position from the noise reducing signal; and evaluating the primary sense signal and controlling the processing of the primary sense signal so that the primary sense signal is processed in the adaptive mode of operation when the magnitude of the primary sense signal undercuts a first threshold and in the non-adaptive mode of operation when the magnitude of the primary sense signal exceeds a second threshold, the first threshold being equal to or smaller than the second threshold.

10. The method of claim 9, further comprising:

generating a secondary sense signal representative of a sound that occurs at the second position; and providing the noise reducing signal by processing the primary sense signal and the secondary sense signal.

11. The method of claim 9, further comprising a hysteresis behavior between the first threshold and the second threshold.

12. The method of claim 9, further comprising:

providing a multiplicity of primary sense signals; and comparing the multiplicity of primary sense signals with a multiplicity of first thresholds and a multiplicity of second thresholds and controlling an active road noise control module so that the method operates in the adaptive mode of operation when the magnitudes of a first number of the multiplicity of primary sense signals undercut their respective first thresholds and operates in the non-adaptive mode of operation when the magnitudes of a second number of the multiplicity of primary sense signals exceed their respective second thresholds.

13. The method of claim 12, further comprising adaptive filtering with a variable transfer function; and the non-adaptive mode of operation includes stopping the adaptation and maintaining the variable transfer function of the adaptive filtering when stopping the adaptation.

14. The method of claim 9, further comprising adaptive filtering with a variable transfer function; and the non-adaptive mode of operation includes stopping the adaptation and setting the variable transfer function of the adaptive filtering to a default transfer function.

15. The method of claim 9, wherein a change from the non-adaptive mode of operation into the adaptive mode of operation includes a reset of an active road noise control module.

16. An active road noise control system comprising:

a sensor arrangement configured to generate a primary sense signal representative of at least one of accelerations, motions, and vibrations that occur at a first position on a vehicle body, the primary sense signal having a magnitude;

an active road noise control module configured to provide a noise reducing signal by processing at least the primary sense signal according to an adaptive mode of operation or a non-adaptive mode of operation at a time;

at least one loudspeaker configured to generate noise reducing sound at a second position within the vehicle body from the noise reducing signal; and an overload detection module configured to receive the primary sense signal and to control the active road noise control module to operate in the adaptive mode of operation when the magnitude of the primary sense signal is below a first threshold and to operate in the non-adaptive mode of operation when the magnitude of the primary sense signal exceeds a second threshold.

17. The system of claim 16, wherein the sensor arrangement is further configured to generate a secondary sense signal representative of a sound that occurs at the second position; and the active road noise control module is further configured to provide the noise reducing signal by processing the primary sense signal and the secondary sense signal.

18. The system of claim 16, wherein the overload detection module is further configured to exhibit a hysteresis behavior between the first threshold and the second threshold.

19. The system of claim 16, wherein:

the sensor arrangement comprises a multiplicity of noise and vibration sensors providing a multiplicity of primary sense signals; and the overload detection module is further configured to compare the multiplicity of primary sense signals with a multiplicity of first thresholds and a multiplicity of second thresholds and to control the active road noise control module so that the active road noise control module operates in the adaptive mode of operation when the magnitudes of a first number of the multiplicity of primary sense signals is below their respective first thresholds and operates in the non-adaptive mode of operation when the magnitudes of a second number of the multiplicity of primary sense signals exceed their respective second thresholds.

20. The system of claim 16, wherein a change from the non-adaptive mode of operation into the adaptive mode of operation includes a reset of the active road noise control module.

* * * * *